US010473423B2

(12) United States Patent
Ortiz

(10) Patent No.: US 10,473,423 B2
(45) Date of Patent: Nov. 12, 2019

(54) TRIGGER PULL STABILIZER FOR HAND-FIRED WEAPON

(71) Applicant: Angel Gregory Ortiz, Conroe, TX (US)

(72) Inventor: Angel Gregory Ortiz, Conroe, TX (US)

( * ) Notice: Subject to any disclaimer, the term of this patent is extended or adjusted under 35 U.S.C. 154(b) by 0 days.

(21) Appl. No.: 15/454,273

(22) Filed: Mar. 9, 2017

(65) Prior Publication Data

US 2017/0176137 A1 Jun. 22, 2017

(51) Int. Cl.

| | |
|---|---|
| ***F41C 27/22*** | (2006.01) |
| ***F41C 33/00*** | (2006.01) |
| ***F41C 23/10*** | (2006.01) |
| ***F41A 19/10*** | (2006.01) |

(52) U.S. Cl.

CPC ..... *F41C 27/22* (2013.01); *F41A 19/10* (2013.01); *F41C 23/10* (2013.01); *F41C 33/001* (2013.01)

(58) Field of Classification Search

CPC ..... F41A 19/07; F41A 19/10; F41A 19/16; F41A 35/00; F41C 23/00; F41C 23/06–23/16; F41C 27/00; F41C 27/22; F41C 33/001

USPC ..... 42/69.01, 71.01–74, 90, 94, 97

See application file for complete search history.

(56) References Cited

U.S. PATENT DOCUMENTS

| | | | | | |
|---|---|---|---|---|---|
| 863,798 | A * | 8/1907 | Hodges | F41A 9/84 | 42/87 |
| 1,971,526 | A * | 8/1934 | Kempf | F41A 9/85 | 42/89 |
| 4,154,014 | A * | 5/1979 | Smith | F41A 17/063 | 42/66 |
| 4,679,343 | A * | 7/1987 | Gomez Harlow | F41A 9/84 | 42/87 |
| 4,835,893 | A * | 6/1989 | Kelso | F41A 11/00 | 42/69.01 |
| 4,878,305 | A * | 11/1989 | Gabrielidis | F41G 1/41 | 42/118 |
| 5,323,754 | A * | 6/1994 | Pittman | F41B 5/1469 | 124/35.1 |
| 5,560,133 | A * | 10/1996 | Kuebler | F41A 17/22 | 42/69.01 |
| 5,666,667 | A * | 9/1997 | Hook, Jr. | A41D 19/01547 | 2/159 |
| 5,848,834 | A * | 12/1998 | Kerr | F21L 15/14 | 362/190 |
| 5,864,884 | A * | 2/1999 | Salvitti | A41D 19/01547 | 2/159 |
| 6,029,321 | A * | 2/2000 | Fisher | F41C 33/001 | 124/35.2 |
| 6,219,953 | B1 * | 4/2001 | Bentley | F41A 9/83 | 42/90 |
| 6,230,371 | B1 * | 5/2001 | Chu | F41C 33/001 | 24/17 B |

(Continued)

*Primary Examiner* — Stephen Johnson
*Assistant Examiner* — Benjamin S Gomberg
(74) *Attorney, Agent, or Firm* — CIONCA IP Law P.C.; Marin Cionca

(57) ABSTRACT

The present invention provides a trigger pull stabilizer for a hand-fired weapon to fill the spacing and gap between the shooter's finger and the weapon's frame wherein the filling in of the space and gap between the shooter's finger and the weapon's frame stabilizes finger movement and improves trigger control and consistent shot placement.

7 Claims, 14 Drawing Sheets

(56) References Cited

U.S. PATENT DOCUMENTS

| | | | | |
|---|---|---|---|---|
| 6,678,986 | B2 * | 1/2004 | Roush | A41D 19/0157 2/159 |
| 6,802,148 | B1 * | 10/2004 | Danas | F41C 23/10 42/71.02 |
| 6,804,907 | B1 * | 10/2004 | Slobodkin | F41C 23/14 42/71.01 |
| 8,307,578 | B1 * | 11/2012 | Azhocar | F41A 17/38 42/108 |
| 8,806,791 | B2 * | 8/2014 | Cottle | F41A 19/11 42/71.01 |
| 8,985,804 | B2 * | 3/2015 | Frazier | F21L 4/00 362/110 |
| 9,310,161 | B2 * | 4/2016 | Ermossa | F41C 23/10 |
| 9,651,336 | B2 * | 5/2017 | Ringgenberg | F41C 33/008 |
| 2005/0188587 | A1 * | 9/2005 | Danas | F41C 23/10 42/72 |
| 2009/0009987 | A1 * | 1/2009 | Graham | F21V 21/0885 362/110 |
| 2014/0007763 | A1 * | 1/2014 | Foster | F41A 19/03 89/136 |
| 2014/0259539 | A1 * | 9/2014 | Ringgenberg | F41C 33/008 24/13 |
| 2016/0061558 | A1 * | 3/2016 | Gilmer | F41C 27/22 42/71.02 |
| 2017/0219312 | A1 * | 8/2017 | Ringgenbert | F41C 23/16 |

* cited by examiner

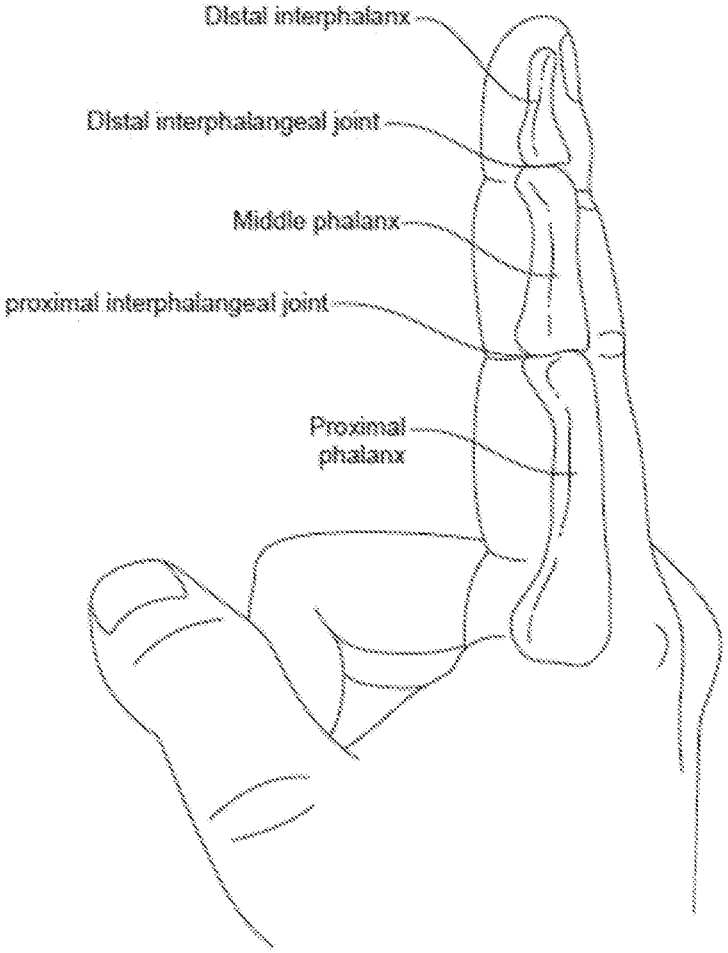
FIG. 1a – Prior Art

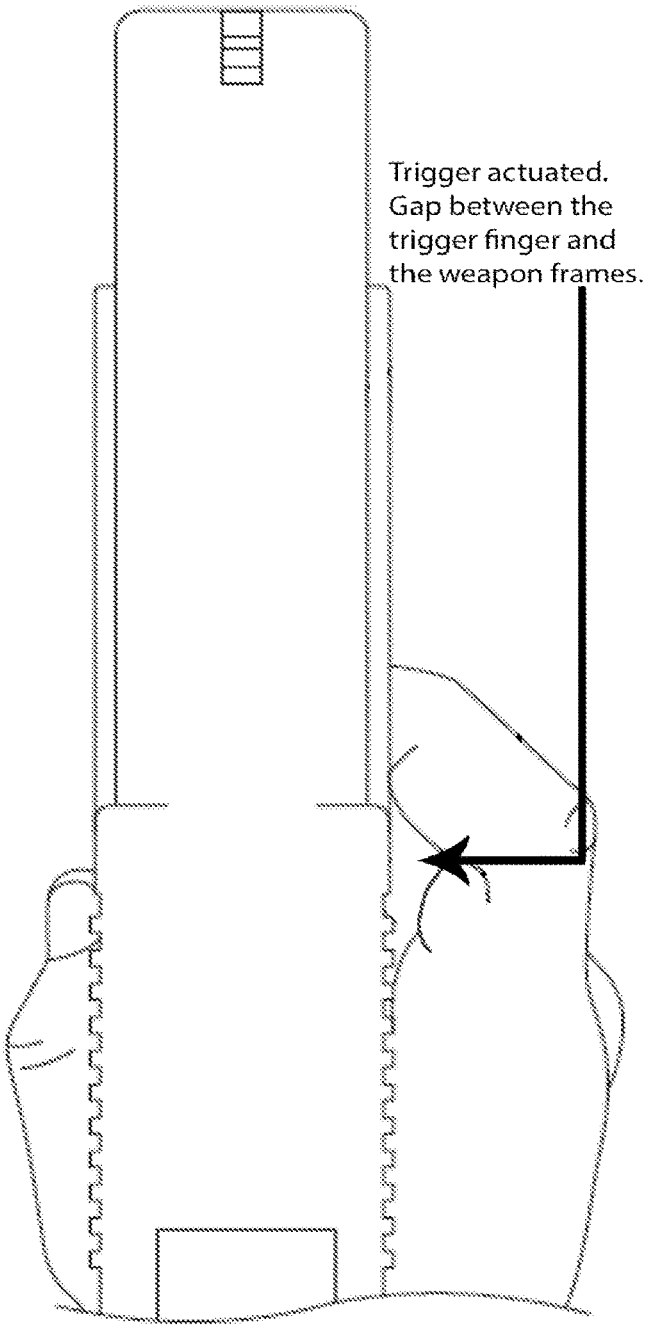
FIG. 1b – Prior Art

TRIGGER PULL STABILIZER FOR HAND-FIRED WEAPON

FIELD OF INVENTION

The present disclosure generally relates to a mechanical enhancement for hand-fired weapons and more particularly to a Trigger Pull Stabilizer (TPS) in conjunction with a trigger of a hand-fired weapon.

DESCRIPTION OF RELATED ART

A trigger is a mechanism that actuates a firing sequence of a firearm or crossbow. A trigger may also start handheld mechanisms such as a trap or a quick release. A small amount of energy applied to the trigger causes the release of much more energy. In "double action" weapon designs, the trigger is also used to cock the weapon—and there are many designs where the trigger is used for a range of other functions. Although triggers usually consist of a lever actuated by the index finger, some such as the M2 Browning machine gun use the thumb, and others like the Springfield Armoury M6 Scout use a "squeeze-bar trigger."

Although there are variations in the way triggers have been implemented, the basic design and concept hasn't seen much of change in decades. A shooter, holding the gun, adopts a stable posture, and stabilizes the hand and fingers to achieve an accurate target shot. The stability of a shooter's fingers is highly affected by a variety of factors including the shooter's ambience and the shooter's emotional state (e.g., panic, shock, and/or adrenaline). The ambiance may be a like war scenario, a close encounter, or areas with harsh temperatures or conditions. Even a minor disturbance in the finger may reduce accuracy and even lead to inappropriate target hitting.

In the view of foregoing, there is a need for a Trigger Pull Stabilizer (TPS) for a hand-fired weapon such as rifles, crossbows, pistols, and revolvers etc. . . .

Also, there is a need for a Trigger Pull Stabilizer (TPS) which statically or dynamically fills the spacing and gap between the shooter's finger and the weapons frame. The filling in of the space and gap between the shooter's finger and the weapon's frame stabilizes finger movement and improves trigger control and consistent shot placement. The Trigger Pull Stabilizer (TPS) device is used to improve trigger control and improve shot placement. The Trigger Pull Stabilizer (TPS) is used during non-firing, practice firing, as well as firing conditions to create seamless flow of force from the finger to the trigger with minimal or no finger vibration or movement which impacts a shooter's trigger control or shot placement.

The above-mentioned shortcomings, disadvantages and problems of weapons without the Trigger Pull Stabilizer (TPS) are addressed herein, as detailed below.

SUMMARY

The primary objective of the embodiments herein is to provide a Trigger Pull Stabilizer (TPS) which statically or dynamically fills in the gap between the finger(s) and weapon's frame to improve trigger control and shot placement, when using hand-fired weapons with a trigger or button actuator.

Another objective of the embodiments herein is to show that the Trigger Pull Stabilizer (TPS) can be part of the weapon's frame, attached to the weapons frame, part of a finger worn ring, ring attachment, or device worn on the finger(s) or a glove, or part of the accessory/grip of a rifle, pistol, revolver or crossbow weapon.

Another objective of the embodiment herein is to provide a Trigger Pull Stabilizer (TPS) as a dynamic gap filling between the finger and the gun trigger during non-firing as well as firing conditions to create seamless flow of force from the finger to the trigger with minimal or no finger vibration to improve trigger control and shot placement.

Yet another object of the present invention is to provide a generic Trigger Pull Stabilizer (TPS) with a releasable assembly so that one Trigger Pull Stabilizer (TPS) can be attached to a plurality of hand-fired weapons, weapon's accessories, gloves, or a shooter's finger(s).

Another objective of the embodiments herein is to show that the Trigger Pull Stabilizer (TPS) can be of any material which makes it conducive for use in any temperature or condition with the intended use of minimizing finger vibration/movement, improving trigger control and improving consistent shot placement.

Another objective of the embodiments herein is to show that the Trigger Pull Stabilizer (TPS) can be of any shape and size. The shape and size is based on the shooter's need, spacing between the shooter's finger(s) and weapon's frame, dependent on if the TPS is part of the weapon's frame, attached to the weapon or frame, part of a weapon's grip/accessories, attached to a weapon's grip/accessories, part of a glove, attached to a glove, or worn on the shooter's finger(s).

According to one embodiment herein, the Trigger Pull Stabilizer (TPS) is referred to as a dynamic gap filler when described. Within this embodiment, the TPS makes use of the Translator, Trigger connected actuator, Radial Motion Translator.

Another objective of the embodiments here is to show that the Trigger Pull Stabilizer (TPS) is static in nature and does not need to use the Translator trigger-connected actuator or radial motion translator. The TPS will either be manufactured into the frame of the weapon's body, attached to the weapon's frame or body, manufactured or part of the weapons accessory or grip, attached to the weapon's accessory or grip, attached to a shooter's finger via a ring-like attachment or finger attached device, attached to hand protectors or gloves, or made part of the shooter's hand protection or glove. When the shooter grips the weapon, the TPS fills the space and gap between the shooter's finger and the weapon's frame. The TPS minimizes the space between the weapon's frame and shooter's finger when actuating the weapon's trigger. By doing this, the TPS in any of its configurations, improves a shooter's trigger control and shot placement, by minimizing or eliminating any vibration or uneven finger movements when actuating the weapon's trigger.

Another objective of the embodiments herein is to show that the Trigger Pull Stabilizer (TPS) for hand-fired weapons comprises of a dynamic gap filler, a trigger-connected actuator and a radial motion translator. The dynamic gap filler is any shape and placed adjacent to the body of the weapon. The trigger-connected actuator is attached to the dynamic gap filler. The trigger-connected actuator initiates a radial movement of the dynamic gap filler during pulling of trigger. The radial motion translator is connected between the dynamic gap filler and the trigger-connected actuator. The trigger connected actuator comprises a base cover connected to the body of the hand-fired weapon and a translator with spring action. The translator is primarily but not in a limited sense connected to a back of the trigger. The translator can also be made part of the weapon's frame or housing during the manufacturing of the weapon's frame. The translator is pushed-in as the trigger is pulled and automatically retains its original position during the trigger's motion back to a resting position. The pushing-in function of the translator results in a radially outward motion of the radial motion translator which further leads to outward movement of the dynamic gap filler.

According to one embodiment herein, the radial motion translator has sliding motion in a radial direction with respect to a weapon body.

According to one embodiment herein, the trigger-connected actuator senses a pulling of trigger and initiates a translator motion of the TPS dynamic gap filler through the radial motion translator to fill in the gap between the finger(s) and the weapon frame during pulling of trigger.

According to embodiments herein, the Trigger Pull Stabilizer (TPS) is attachable and removable in nature.

According to embodiments herein, the Trigger Pull Stabilizer (TPS) is part of the weapon's frame. When the shooter grabs the weapon's grip, the gap between the shooter's finger(s) and the weapon's frame is minimized or removed.

According to embodiments herein, the Trigger Pull Stabilizer (TPS) is part of a weapon's grip accessory. When the shooter grabs the weapon's grip, the gap between the shooter's finger(s) and the weapon's frame is minimized or removed.

According to one embodiment herein, the Trigger Pull Stabilizer (TPS) is attachable to, or part of a shooter's glove or hand protection. When the shooter grabs the weapon's grip, the gap between the shooter's finger(s) and the weapon's frame is minimized or removed.

According to one embodiment herein, the Trigger Pull Stabilizer (TPS) is attachable to a shooter's finger(s) via a ring, ring like attachment, or finger attachment. When the shooter grabs the weapon's grip, the gap between the shooter's finger(s) and the weapon's frame is minimized or removed.

According to one embodiment herein, the TPS is made up of a of any material such as metal, nylon based polymer, polymer, plastic, alloys, aluminium, fibreglass, vinyl, foam, polymer rubber, silicon, or any material which makes the TPS conducive for its intended use or implementation as an attachment, for use on a shooter's finger(s), as part of a glove or hand protection, part of the weapon's frame, part of the weapon's accessory or grip, or part of the weapon's housing.

According to one embodiment herein, the trigger connected actuator is made up of a material selected from the group consisting of metal, alloys, aluminium, nylon based polymer, polymer, plastic, fibreglass, vinyl, foam, polymer rubber, silicon or any material which makes the TPS conducive for its intended use or implementation.

According to one embodiment herein, the radial motion translator is made up of a material selected from the group consisting metal, alloys, aluminium, nylon based polymer, polymer, plastic, fibreglass, vinyl, foam, polymer rubber, silicon or any material which makes the TPS conducive for its intended use or implementation.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof.

BRIEF DESCRIPTION OF THE DRAWINGS

The other objects, features and advantages will occur to those skilled in the art from the following description of the preferred embodiment and the accompanying drawings in which:

FIG. 1*a* illustrates a human finger anatomy to understand primal function of force applied on or by the finger bones over a trigger of a hand-fired weapon, according to one embodiment herein.

FIG . 1*b* illustrates the spacing between the shooter's finger and the weapon's frame. The TPS is used to fill in the spacing between the shooter's finger and the weapon's frame.

Figure 2A:
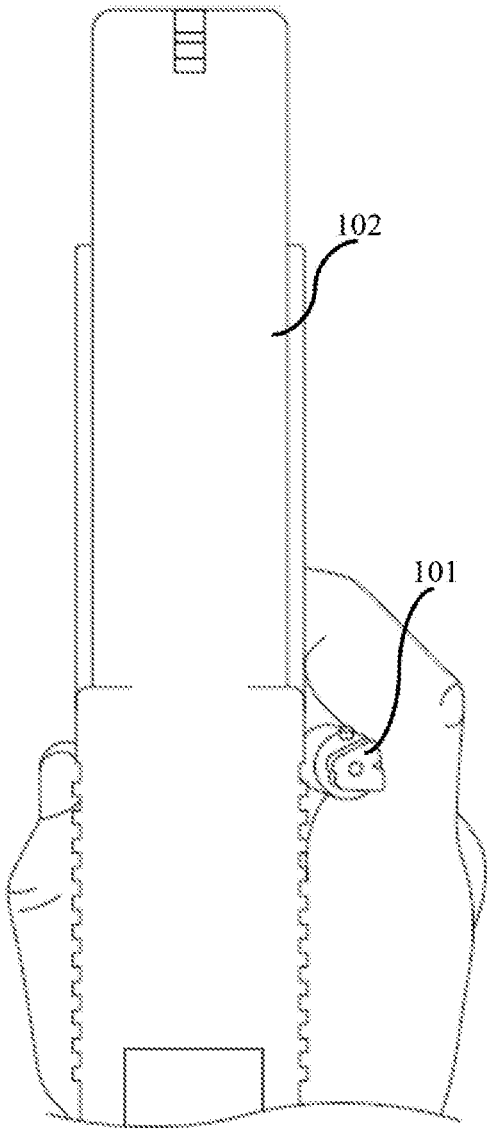
Figure 2B:
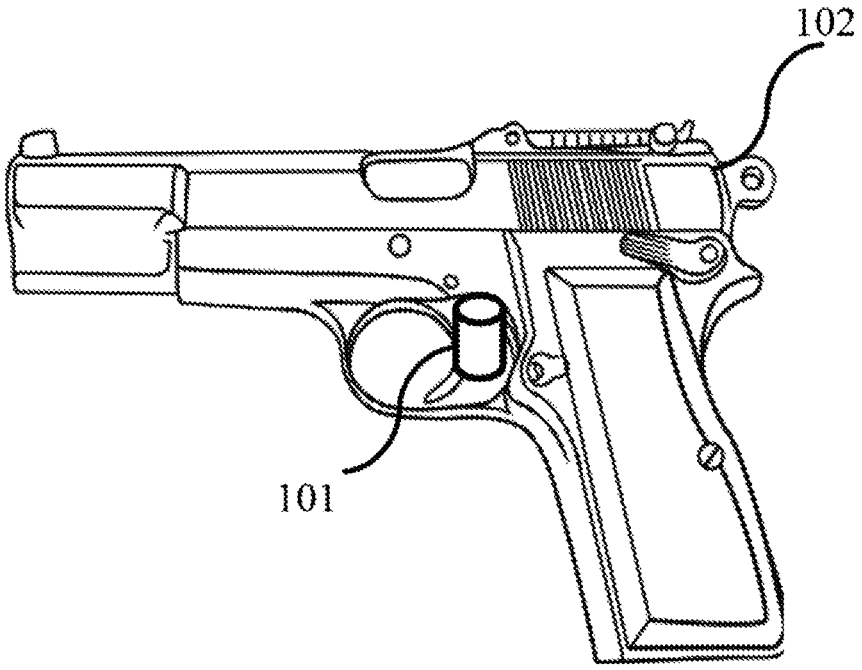
Figure 2C:
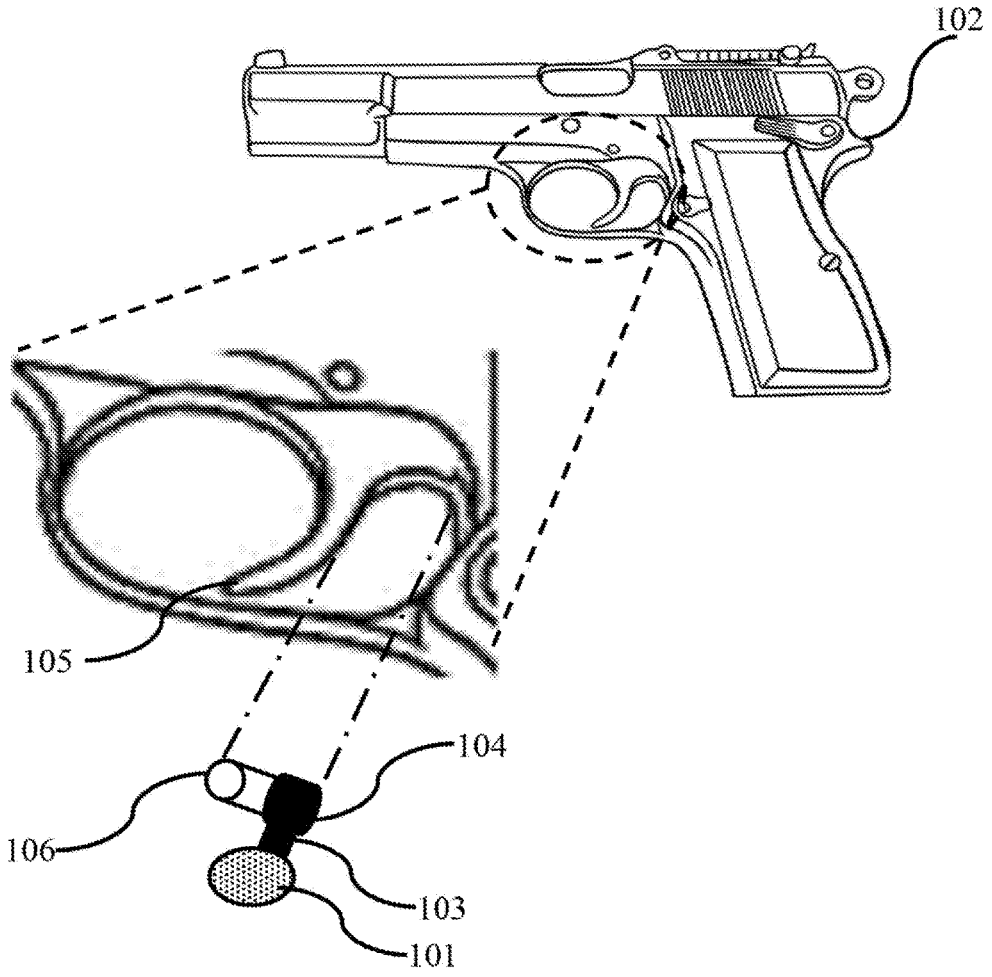

FIGS. 2*a*, 2*b* and 2*c* illustrates a top view, a side view and an exploded view respectively of an assembly of a TPS with a hand-fired weapon, according to one embodiment herein.

Figure 2D:
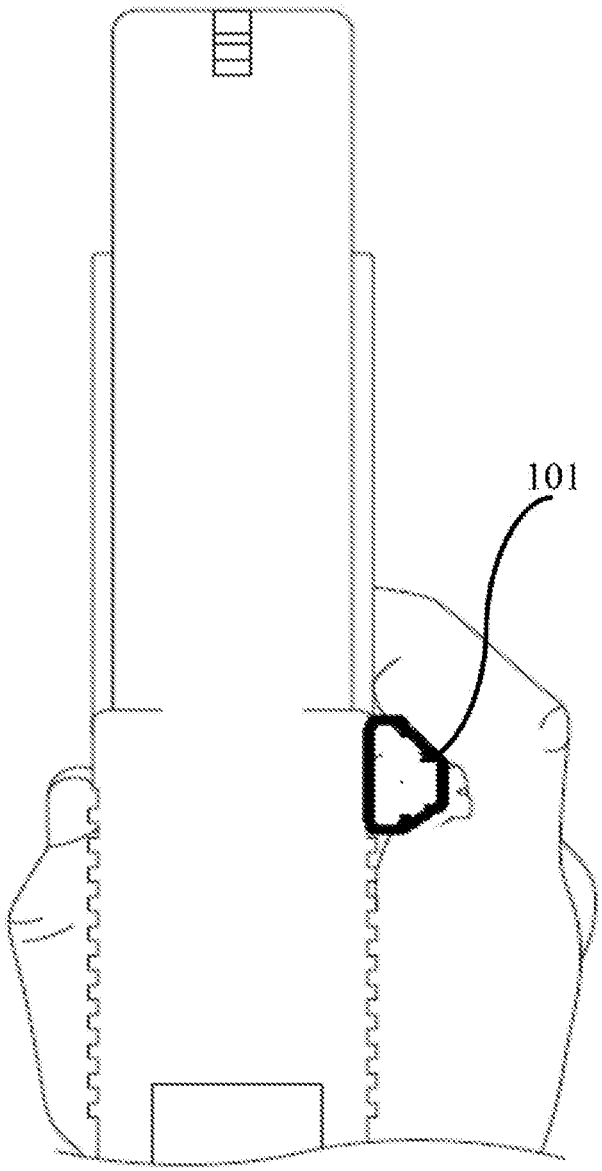

FIG. 2*d* illustrates a top view of the rhomboidal TPS that is attached to the body of the hand fired weapon or is manufactured into the hand fired weapon's frame and body, or is part of the weapon's accessory or grip, according to one embodiment herein.

Figure 3A:
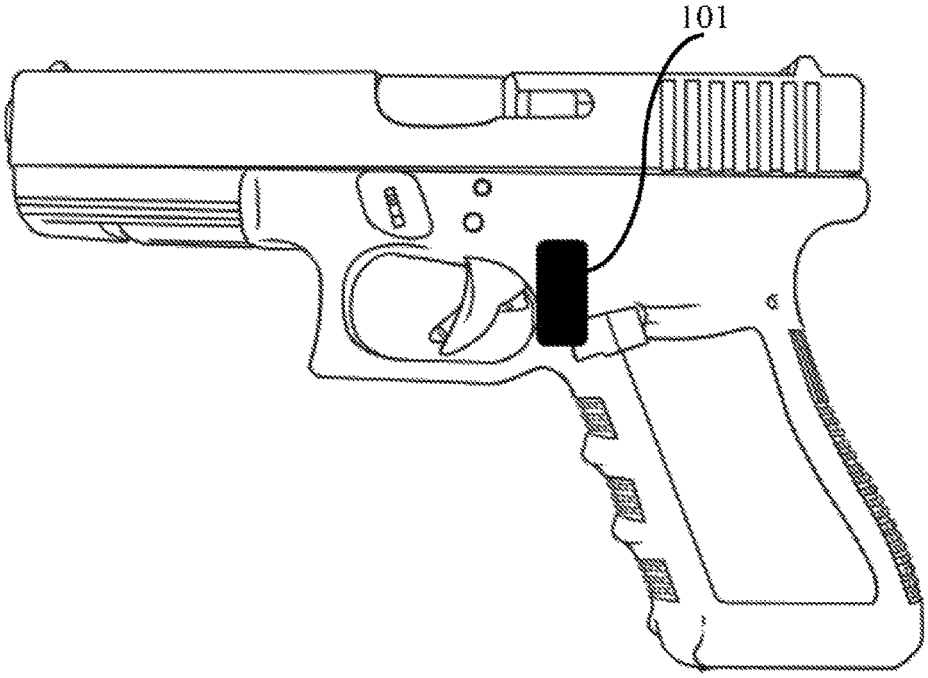

FIG. 3*a* illustrates a side view of a pistol or a short ammunition enabled weapon with the TPS attached to the weapon's frame or body, or manufactured into the weapon's frame or body, or part of the weapon's accessory or grip, according to one embodiment herein.

Figure 3B:
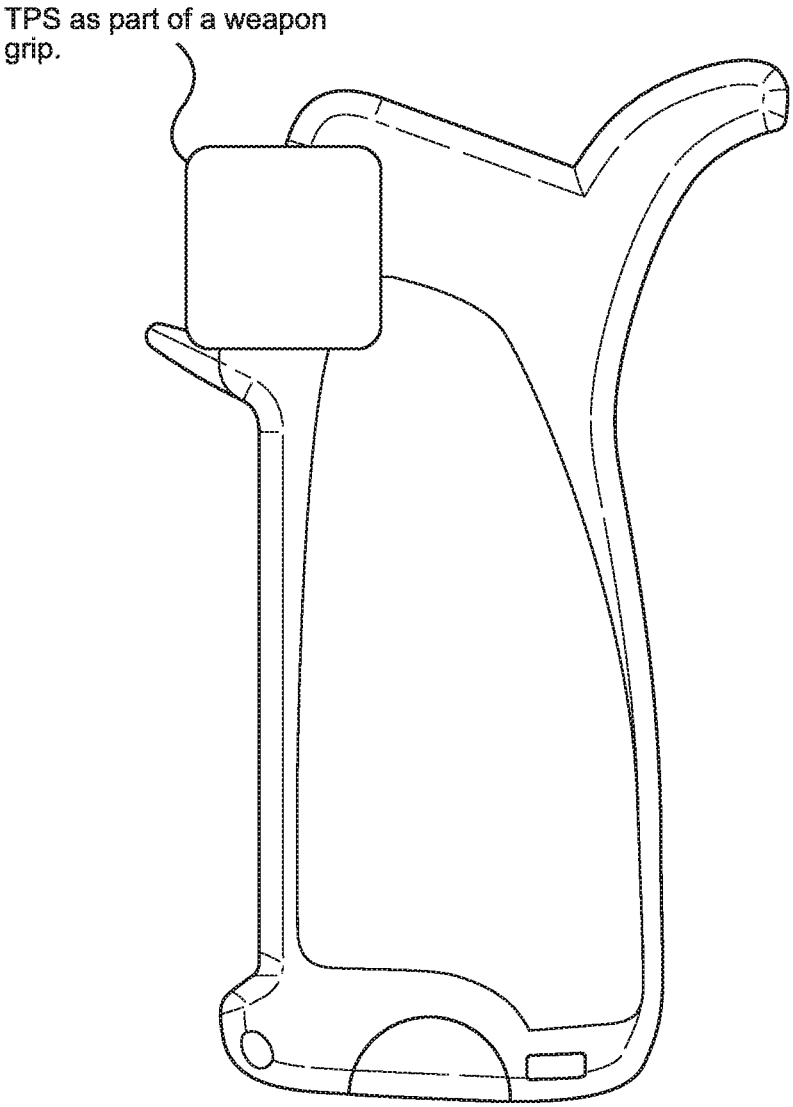
Figure 3C:
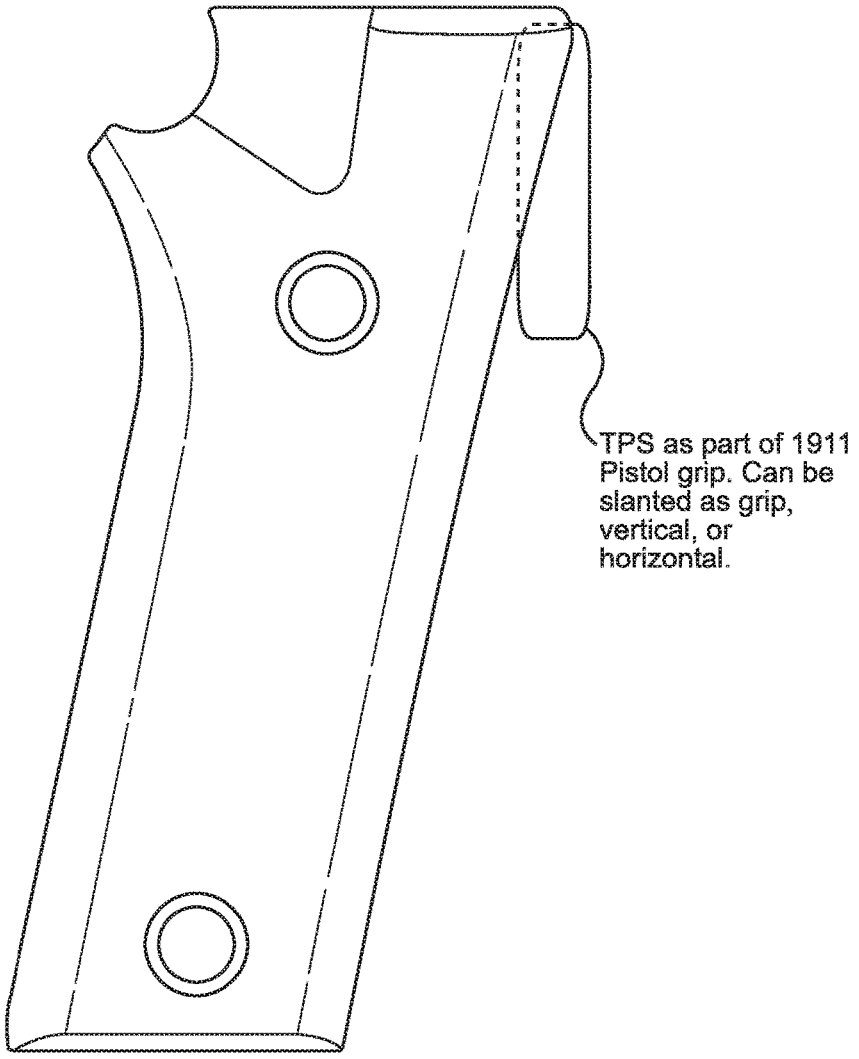

FIGS. 3*b* and 3*c* illustrates a side view of the TPS attached to the weapon's grip, or manufactured into the weapon's grip per one embodiment herein.

Figure 4:
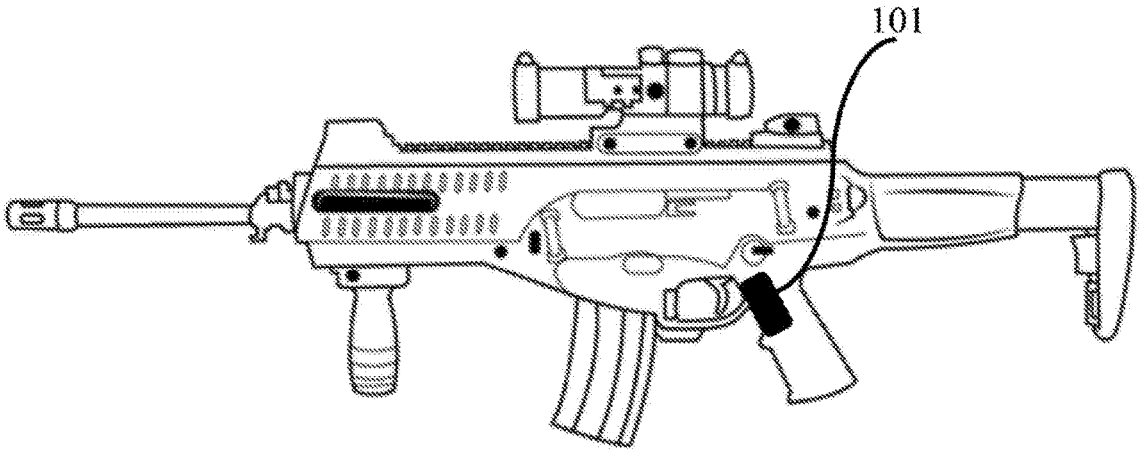

FIG. 4 illustrates a side view of a rifle/large ammunition enabled weapon with the TPS attached to the weapon, attached to or part of the weapon's accessory or grip, or part of the weapon body or frame, according to one embodiment herein.

Figure 5:
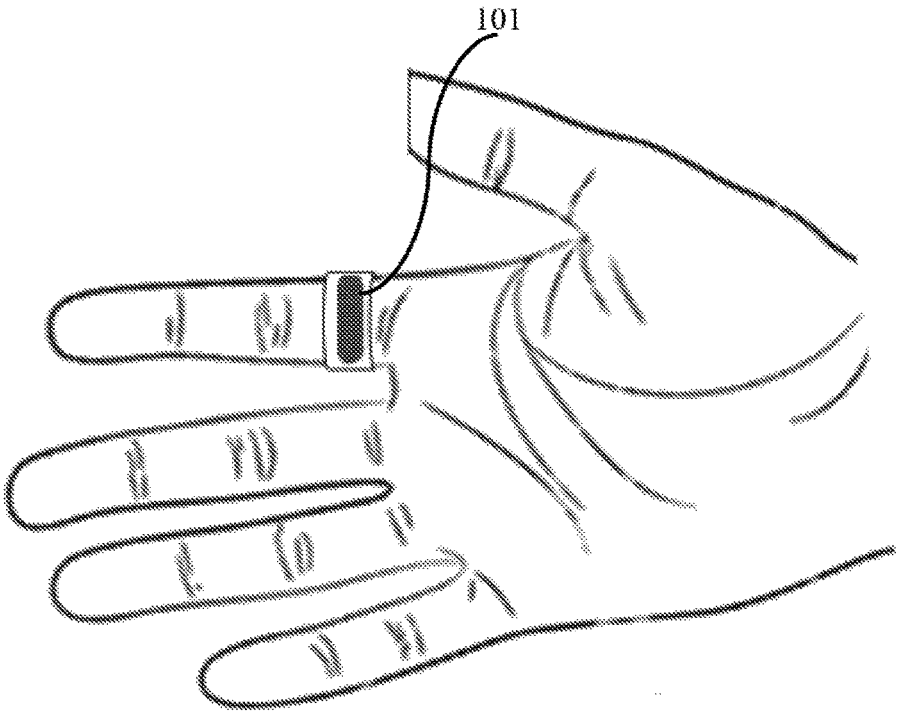
Figure 6:
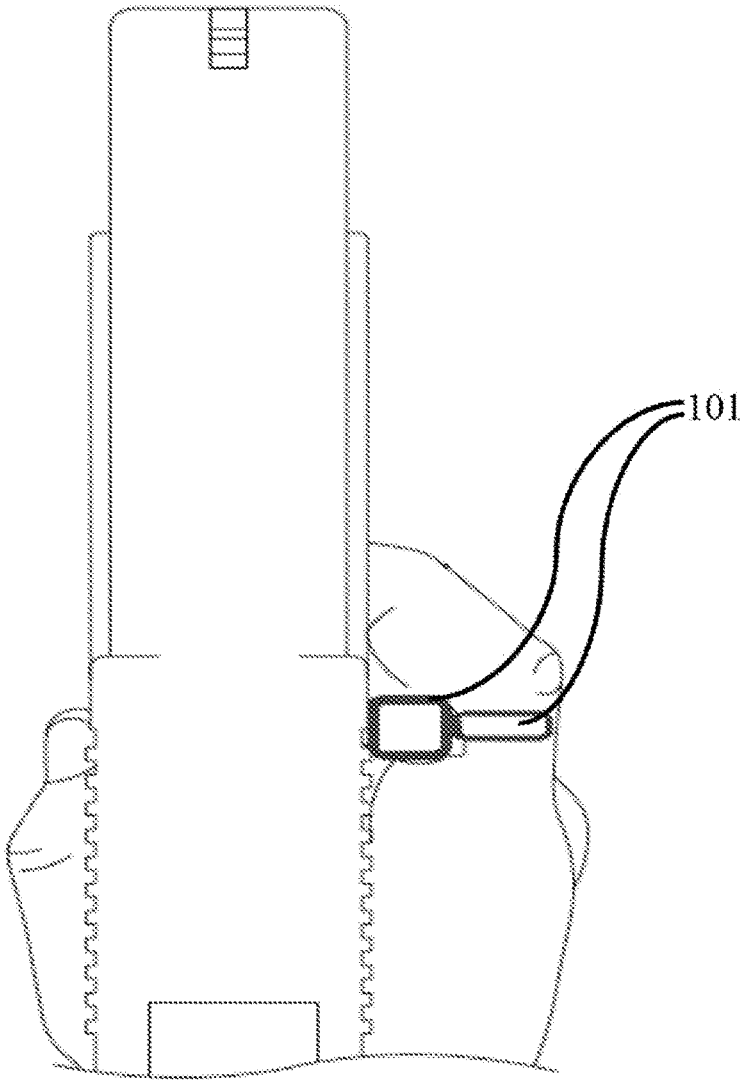

FIG. 5 illustrates an exemplary view of a ring shaped TPS fitted into one of the fingers of a shooter, according to one embodiment herein FIG. 6 illustrates an exemplary top view of a combination of the ring shaped TPS worn by the shooter (FIG. 5) and the shooter holding/gripping a weapon.

Figure 7:
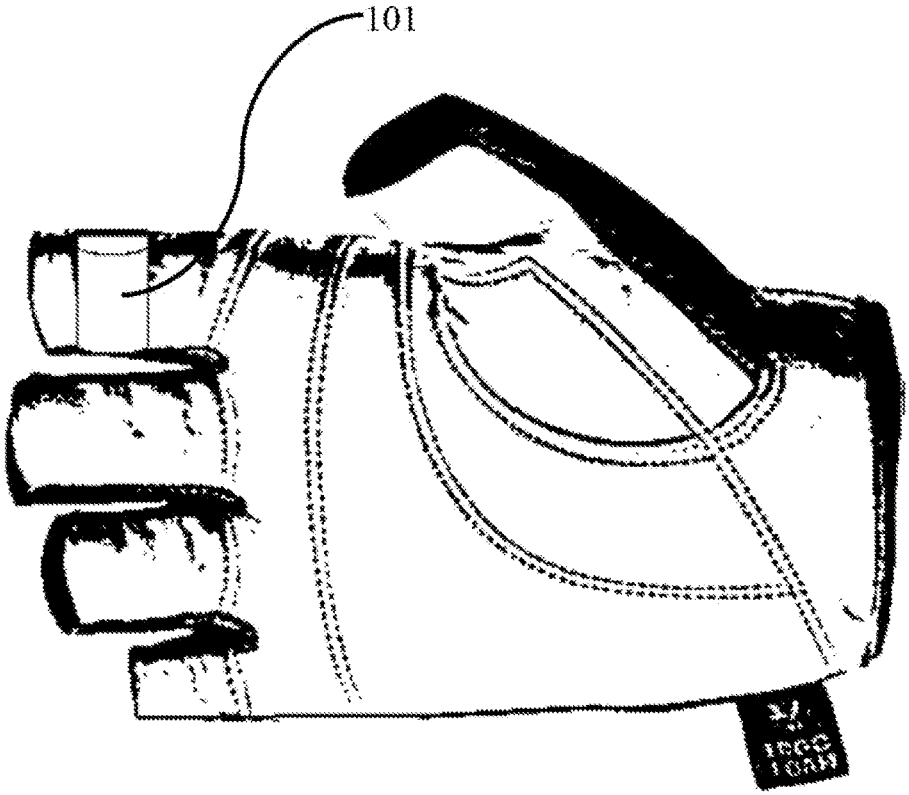

FIG. 7 illustrates an exemplary view of the TPS enabled on the surface, within the material, or internally within the glove or hand protection of the shooter, according to one embodiment herein.

Figure 8:
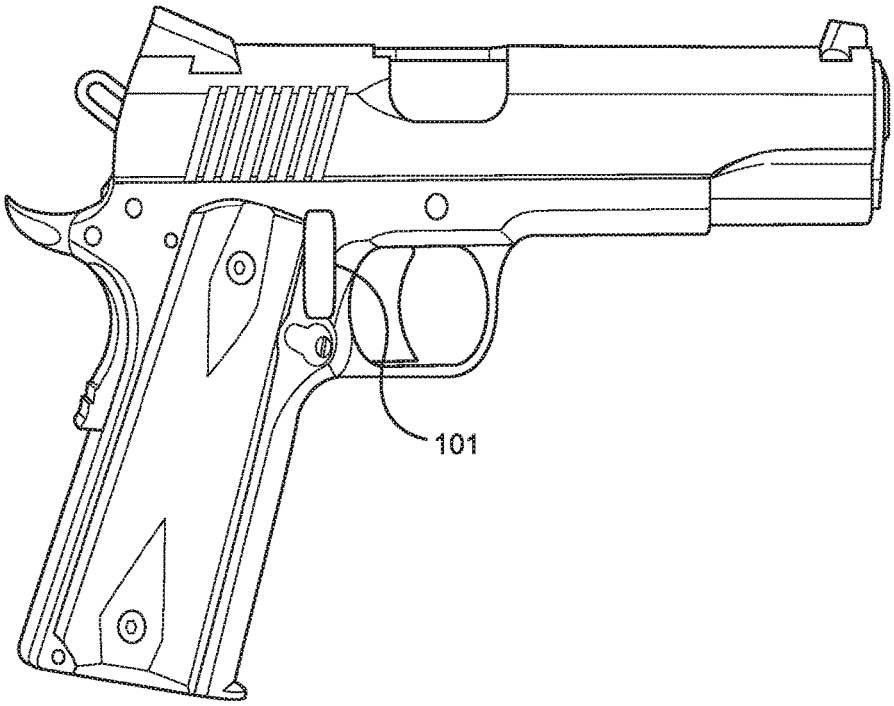

FIG. 8—illustrates a side view of the TPS attached to the weapon's grip, or manufactured into the weapon's accessory or grip, and the weapon's accessory or grip attached to the weapon according to one embodiment herein; or part of or manufactured into the weapon's frame.

DETAILED DESCRIPTION OF THE DRAWINGS

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The Trigger Pull Stabilizer (TPS) is used to fill the space and gap between the human finger and a weapon's frame. The TPS can be implemented in different configurations as mentioned and referenced within this document. The following detailed description(s) of the Trigger Pull Stabilizer (TPS) is therefore not to be taken in a limiting sense.

FIG. 1*a* illustrates a human finger anatomy to understand force applied on or by the finger bones over a trigger of a hand-fired weapon. With respect to FIG. 1*b* Trigger Pull Stabilizer (TPS) rests between the shooter's trigger finger and a weapon's frame. The location of the TPS relative to the shooter's finger depends on where the shooter's finger requires the stability. The Trigger Pull Stabilizer (TPS) is used to fill the space/gap between the human finger and a weapon's frame. To provide finger stability during an actuation of the weapon's trigger, the trigger finger's Distal, Middle, or Proximal phalanx region is placed on the TPS. Once the trigger finger's Distal, Middle or Proximal phalanx region is placed on the TPS, the weapon's trigger is actuated smoothly with minimal vibrations or sideway finger motions that can affect shooting accuracy.

FIGS. 2*a*, 2*b* and 2*c* illustrates a top view, a side view and an exploded view respectively of an assembly of a Trigger Pull Stabilizer (TPS) with a hand-fired weapon having a top side, a bottom side, a front end, a left side, a right side, and a rear end, with a handle at the rear end and a muzzle at the front end, per one embodiment herein. Within this description, the TPS (101) is referred to as a dynamic gap filler because the TPS (101) dynamically files the gap between the shooter's trigger finger, as shown in the top view of FIG. 2*a* as an example, and weapon's frame dynamically when actuating 105 (Trigger), 106 (Translator), 104 (Trigger connected Actuator), and 103 (radial motion translator). With respect to FIGS. 2*a*, 2*b* and 2*c*, Trigger Pull Stabilizer (TPS) for a hand-fired weapon 102 comprising a dynamic gap filler 101 (TPS), a trigger-connected actuator and a radial motion translator 103. The dynamic gap filler 101 (TPS) in this example is a tubular structure placed adjacent to the body of the weapon 102. However, the dynamic gap filler 101 (TPS) can be any shape as stated previously. The trigger-connected actuator is attached to the dynamic gap filler 101 (TPS). The trigger-connected actuator 104 initiates a radial movement of the dynamic gap filler 101 (TPS) during pulling of trigger 105. The radial motion translator 103 is connected between the dynamic gap filler 101 (TPS) and the trigger-connected actuator (104). The trigger connected actuator comprises a base cover 104 connected or encased within the body of the hand-fired weapon and a translator 106 with spring action. The translator 106 is primarily but not in a limited sense connected to a back of the trigger. The translator 106 is pushed-in as the trigger is pulled and automatically retains its original position during the trigger's 105 motion back to a resting position. The pushing-in function of the translator 106 results in a radially outward motion of the radial motion translator 103 which further leads to outward movement of the dynamic gap filler 101 (TPS). The TPS (101), Translator (106), Radial Motion Translator (103), and Trigger Connected Actuator (104) can be manufactured into the weapon's frame, attached to the weapon's frame, part of a hand attachment such as a glove.

According to one embodiment herein, the radial motion translator has sliding motion in a radial direction with respect to a weapon body. This radial motion fills the space and gap between the shooter's finger and the weapon's frame to minimize vibration or sideway motion of the finger while pulling the weapon's trigger. This stability improves the shooter's desired location for shot placement.

According to one embodiment herein, the trigger-connected actuator (104) senses a pulling of trigger via the translator (106) and initiates a radial translator motion of the dynamic gap filler 101 (TPS) through the radial motion translator (103) to fill an increasing gap between the finger and the weapon body during pulling of trigger.

According to embodiment(s) herein, the Trigger Pull Stabilizer (TPS) is attachable and removable in nature.

According to one embodiment herein, the Trigger Pull Stabilizer (TPS) is attachable to a glove, or manufactured into the gloves of finger clothing (FIG. 7). When the shooter grips the weapon with the glove, the TPS fills the space and gap between the shooter's finger and the weapon's frame.

According to one embodiment herein, the Trigger Pull Stabilizer (TPS) is worn on the shooter's finger such that when the shooter grips the weapon, the TPS fills the space and gap between the shooter's finger and the weapon's frame. (FIG. 5) In this case the TPS is held in place on the shooter's finger by a ring like attachment.

According to one embodiment herein, the Trigger Pull Stabilizer (TPS) is part of weapon or manufactured into the weapon's frame.

According to one embodiment herein, the Trigger Pull Stabilizer (TPS) is attachable to a weapon's accessory or grip.

According to one embodiment herein, the Trigger Pull Stabilizer (TPS) is manufactured into the weapon's accessory or grip.

The Trigger Pull Stabilizer (TPS) has a less complex and generic design that results in its enablement/use with a wide range of hand-fired weapons such as hand guns, rifles, cross-bows, sniper rifles or any weapon requiring the hand to fire the weapon. The Trigger Pull Stabilizer (TPS) stabilizes a finger against the weapon which results in higher accuracy shots.

It is to be understood that the phraseology or terminology employed herein is for description and not of limitation. Therefore, while the embodiments herein have been described in terms of preferred embodiments, those skilled in the art will recognize that the embodiments herein can be practiced with modification within the spirit and scope of the claims.

FIG. 2*d* shows the top view of a TPS that has a rhombus shape and filling the space and gap between the shooter's finger and the weapon's frame. The material of the TPS can be any material as previously stated.

FIG. 3*a* shows the side view of a TPS that is either part of the weapon's frame, attached to the weapon's frame, or part of the grip.

FIGS. 3*b* and 3*c* show a side view of a TPS that is part of accessories weapon's grip. FIGS. 3*b* and 3*c* show the TPS that is either manufactured into the weapon's grip or attached to the weapon's grip. The weapon grips can then be attached to the weapon.

FIG. 4 shows a side view of a TPS which is part of a military style rifle. The TPS is either part of the rifle frame, attached to the rifle's frame, or attached to a grip that is used by the rifle.

What is claimed is:

1. A trigger pull stabilization device for use with a hand fired weapon having a frame having a top side, a bottom side, a front end, a left side, a right side, and a rear end; the weapon further having a trigger, a handle at the rear end and extending downwards from the bottom side, and a muzzle at the front end, the trigger pull stabilization device comprising: a trigger pull stabilizer, the trigger pull stabilizer being adapted to fill a gap between a trigger finger of a shooter and the frame of the hand fired weapon, wherein the gap has a first size before an actuation of the trigger, and wherein the gap has a second size during the actuation of the trigger, the second size being larger than the first size; wherein the trigger pull stabilizer extends from the trigger finger of the shooter to the left side or the right side of the frame of the weapon before and during the actuation of the trigger; and a ring connected to the trigger pull stabilizer, the ring being adapted to fit onto the trigger finger of the shooter, and secure the trigger pull stabilizer to the trigger finger of the shooter, such that the trigger pull stabilizer remains between the frame of the weapon and the ring, such that the trigger pull stabilizer extends from the trigger finger of the shooter within the ring to the frame of the weapon and such that the trigger pull stabilizer remains beside the trigger finger of the shooter when the gap increases from the first size to the second size when the shooter grips the handle and actuates the trigger of the hand fired weapon, and such that vibration or sideways movements of the trigger finger of the shooter are minimized during the actuation of the trigger.

2. The trigger pull stabilization device according to claim 1, wherein the trigger pull stabilizer is removably connected to the ring.

3. The trigger pull stabilization device of claim 1, where said trigger pull stabilizer is rotatable along the weapon frame.

4. The trigger pull stabilization device of claim 1, wherein the trigger pull stabilizer is integral to the ring.

5. The trigger pull stabilization device according to claim 1, wherein the trigger pull stabilizer is made of a material selected from the group consisting of metal, nylon-based polymer, plastic, aluminum, fiberglass, vinyl, foam, polymer rubber, and silicon.

6. The trigger pull stabilization device according to claim 1, wherein said trigger pull stabilizer comprises an upper surface having a shape, the shape being selected from the group consisting of an oval, a rhombus, a rectangle, a half-moon, a wedge, and a ring.

7. A trigger pull stabilization device for use with a hand fired weapon having a frame and a trigger, the trigger pull stabilization device comprising: a trigger pull stabilizer, the trigger pull stabilizer being adapted to fill a gap between a trigger finger of a shooter and the frame of the hand fired weapon, wherein the gap has a first size before an actuation of the trigger, and wherein the gap has a second size during the actuation of the trigger, the second size being larger than the first size; wherein the trigger pull stabilizer extends from the trigger finger of the shooter to the frame of the weapon before and during the actuation of the trigger; and a ring connected to the trigger pull stabilizer, the ring being adapted to fit onto the trigger finger of the shooter, and secure the trigger pull stabilizer to the trigger finger of the shooter, such that the trigger pull stabilizer remains between the frame of the weapon and the ring, such that the trigger pull stabilizer extends from the trigger finger of the shooter within the ring to the frame of the weapon and such that the trigger pull stabilizer remains beside the trigger finger of the shooter when the gap increases from the first size to the second size when the shooter grips the handle and actuates the trigger of the hand fired weapon, and such that vibration or sideways movements of the trigger finger of the shooter are minimized during the actuation of the trigger.

* * * * *